US007685652B2

(12) United States Patent
Digney

(10) Patent No.: US 7,685,652 B2
(45) Date of Patent: Mar. 30, 2010

(54) GARMENT

(76) Inventor: Jeanette Ann Digney, 247 Darlington Drive, Banora Point NSW 2468 (AU)

( * ) Notice: Subject to any disclaimer, the term of this patent is extended or adjusted under 35 U.S.C. 154(b) by 209 days.

(21) Appl. No.: 10/503,997

(22) PCT Filed: Dec. 8, 2003

(86) PCT No.: PCT/AU03/01649

§ 371 (c)(1),
(2), (4) Date: Aug. 9, 2004

(87) PCT Pub. No.: WO2005/046370

PCT Pub. Date: May 26, 2005

(65) Prior Publication Data

US 2006/0236443 A1 Oct. 26, 2006

(30) Foreign Application Priority Data

Nov. 12, 2003 (AU) ..... 2003100936

(51) Int. Cl.
*A41B 9/04* (2006.01)
*A41B 9/00* (2006.01)

(52) U.S. Cl. ..... 2/406

(58) Field of Classification Search ..... 2/400–408; 602/67–72; 604/385–400
See application file for complete search history.

(56) References Cited

U.S. PATENT DOCUMENTS

| | | | | |
|---|---|---|---|---|
| 1,742,399 | A * | 1/1930 | Klein | 602/70 |
| 1,920,648 | A * | 8/1933 | Lane | 602/70 |
| 5,243,974 | A * | 9/1993 | Allen | 607/108 |
| 5,769,835 | A * | 6/1998 | Fell et al. | 604/385.28 |
| 6,058,514 | A | 5/2000 | Hart | |
| 6,334,223 | B1 * | 1/2002 | Pieri | 2/455 |
| 6,560,786 | B2 * | 5/2003 | Lipton | 2/400 |
| 6,817,038 | B2 * | 11/2004 | Blanco | 2/406 |
| D507,856 | S * | 8/2005 | Yeramyan et al. | D2/712 |

FOREIGN PATENT DOCUMENTS

| | | |
|---|---|---|
| AU | 54977/73 | 12/1974 |

* cited by examiner

*Primary Examiner*—Gloria Hale
(74) *Attorney, Agent, or Firm*—Kirton & McConkie; Evan R. Witt

(57) ABSTRACT

A garment including in combination a crotch panel defined by a top edge and bottom edge, said top and bottom edges joined by side edges, said top and bottom edges and side edges defining top and bottom corners, respectively on either side of the panel, a pair of leg encircling strap members, each strap member extending from a top corner to a corresponding bottom corner on either side of the panel, wherein in use, the strap members encircle each leg of a wearer preferably below the wearers hip line and extend under each buttock and the crotch panel is located and positioned without any portion of the garment covering the cheeks of the buttocks or across the wearers back.

15 Claims, 4 Drawing Sheets

GARMENT

FIELD OF THE INVENTION

This invention relates to garments in particular but not exclusively to a novel undergarment, beach or swimwear without a waistband and wherein the garment imparts the impression no briefs are being worn underneath clothes.

BACKGROUND OF THE INVENTION

Prior art fashionable garments are well known. The aim of fashion designers in this field is to design garments, particularly for women's fashion, that appear as if none are actually being worn. Such prior art designs have included hipster briefs, g-strings, the Brazilian thong which is also used as beach or swimwear and other designs, which invariably have a narrow support member passing between the cheeks of the wearer's buttocks. Invariably these briefs are also supported by a horizontal rear waistband. Such designs are prone to the problems of "riding up" the wearers body as a result of frictional contact with the outer garment, in most cases, pants or jeans, thereby causing discomfort by applying pressure to the perineal region of the wearer, colloquially known in Australia as a "wedgie". The wearer is continually required to adjust the position of the garment by pulling it through the outer clothing, which can be embarrassing and unsightly.

In addition, the top of the waistband of the inner garment is often exposed due to its riding up between the legs of the outer garment and this is especially evident when the wearer is bending over thereby revealing the garment over the top of outer garments such as shorts, trousers and skirts. The problem is exacerbated, as designs get briefer which do not position or locate the crotch panel without continual adjustment and discomfort to the wearer. Furthermore, a smooth profile or contour of the buttocks cannot be attained in the interest of fashion by having a waistband or a panty line outlining the buttocks, in the modeling industry, this is often solved by models themselves not wearing any garments. This however is not practical in the case of everyday wear nor for hygienic reasons.

OBJECT OF THE INVENTION

It is therefore an object of the present invention to provide an garment which alleviates some of the disadvantages of prior art garments as herein before mentioned or to at least provide the public with a useful choice.

STATEMENT OF THE INVENTION

In one aspect therefore, the invention resides in a garment including in combination a crotch panel defined by a top edge and bottom edge, said top and bottom edges joined by side edges, said top and bottom edges and side edges defining top and bottom corners respectively on either side of the panel, a pair of leg encircling strap members, each strap member extending from a top corner to a corresponding bottom corner on either side of the panel, wherein in use, the strap members encircle each leg of a wearer preferably below the wearers hip line and extend under each buttock and the crotch panel is located and positioned without any portion of the garment covering the cheeks of the buttocks or extending across the back of the wearer.

In another aspect therefore, the invention resides in an garment including in combination a crotch panel defined by a top edge and bottom edge, said top and bottom edges joined by side edges, said top and bottom edges and side edges defining top and bottom corners, respectively on either side of the panel, a pair of leg encircling strap members, each strap member extending from a top corner to a corresponding bottom corner on either side of the panel, wherein in use, the strap members encircle each leg of a wearer preferably below the wearers hip line and extend under each buttock whereby each buttock is supported and lifted and the crotch panel is located and positioned without any portion of the garment covering the cheeks of the buttocks or across the back of the wearer to present a smooth contour of the buttocks and the wearer's back when covered by an outer garment.

Preferably, the crotch panel or the entire garment can be made of a disposable material.

Preferably the disposable material is an absorbent material adapted to absorb bodily fluids.

Preferably the leg encircling strap members are elasticized or are made of materials to look invisible and may include length adjustment means, for example, buckles or VELCRO hook and loop fastener means or hook and eye. The strap members may be detatchable from the crotch panel.

Alternately the strap members can be detachable from the crotch panel.

Preferably the crotch panel has a floating inner lining for preventing contact between and the inner surface of the crotch panel and the crotch of the wearer.

Preferably the garment or at least the crotch panel is of a stretchable material, for example, LYCRA spandex or nylon, and the inner lining is of an inert non-yeast propagating material such as pure cotton or cotton LYCRA spandex.

BRIEF DESCRIPTION OF THE DRAWINGS

In order that the invention be better understood and put into practical effect, reference will now be made to the accompanying drawings wherein.

DETAILED DESCRIPTION OF THE PREFERRED EMBODIMENT

Figure 1:
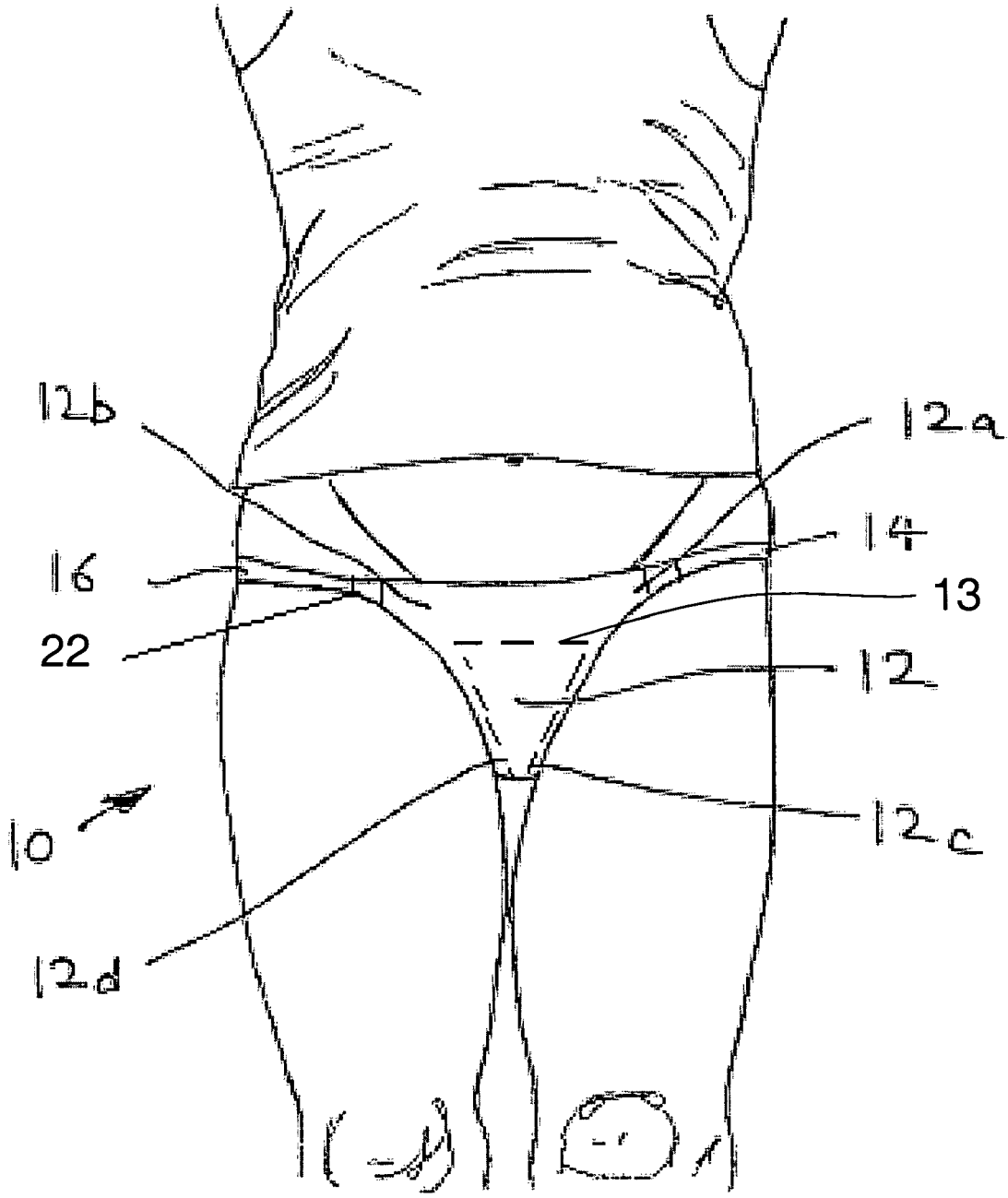
FIG. 1 shows a preferred embodiment of the invention as an undergarment.

Referring now to FIG. 1, there is shown a preferred example of an undergarment herein described according to the invention.

The undergarment 10 comprises a substantially trapezoidal crotch panel 12 having strap members 14, 16 extending from the top corners 12*a*, 12*b* on either side of the crotch panel and joining the bottom corners 12*c*, 12*d* of the crotch panel.

Preferably the crotch panel 12 is made of LYCRA spandex or nylon with an inner lining 13 (shown in phantom) of pure cotton to counteract any possibility of yeast based infections.

Preferably the front of the crotch panel 12 can have embroidery 13 or ornamental additions.

In order to use the undergarment, the wearer steps into the strap members 14, 16, which encircle the legs of the wearer.

Figure 2:
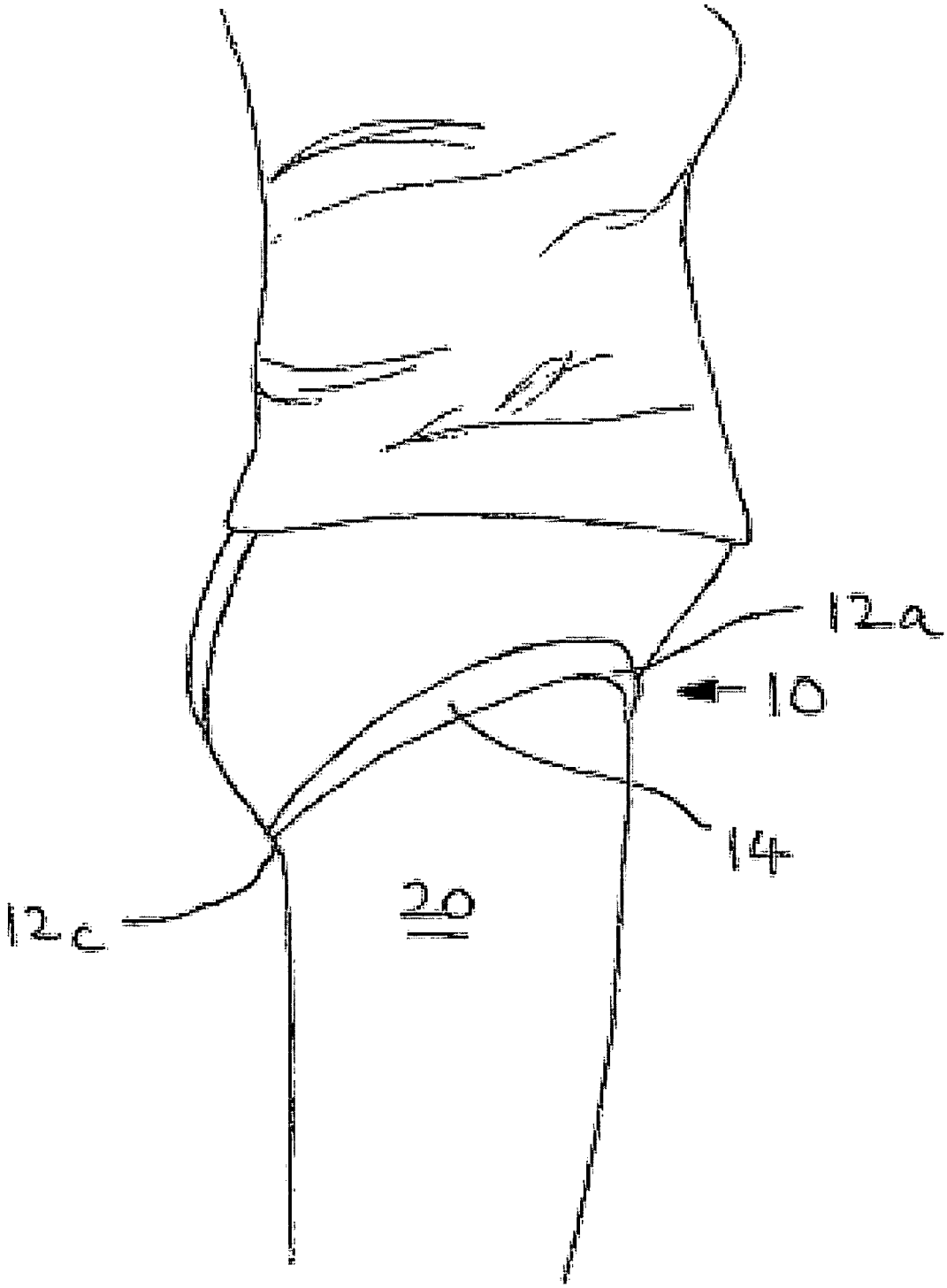
FIGS. 2 and 3 show front, rear and side views of the invention as worn by a wearer.
Figure 3:
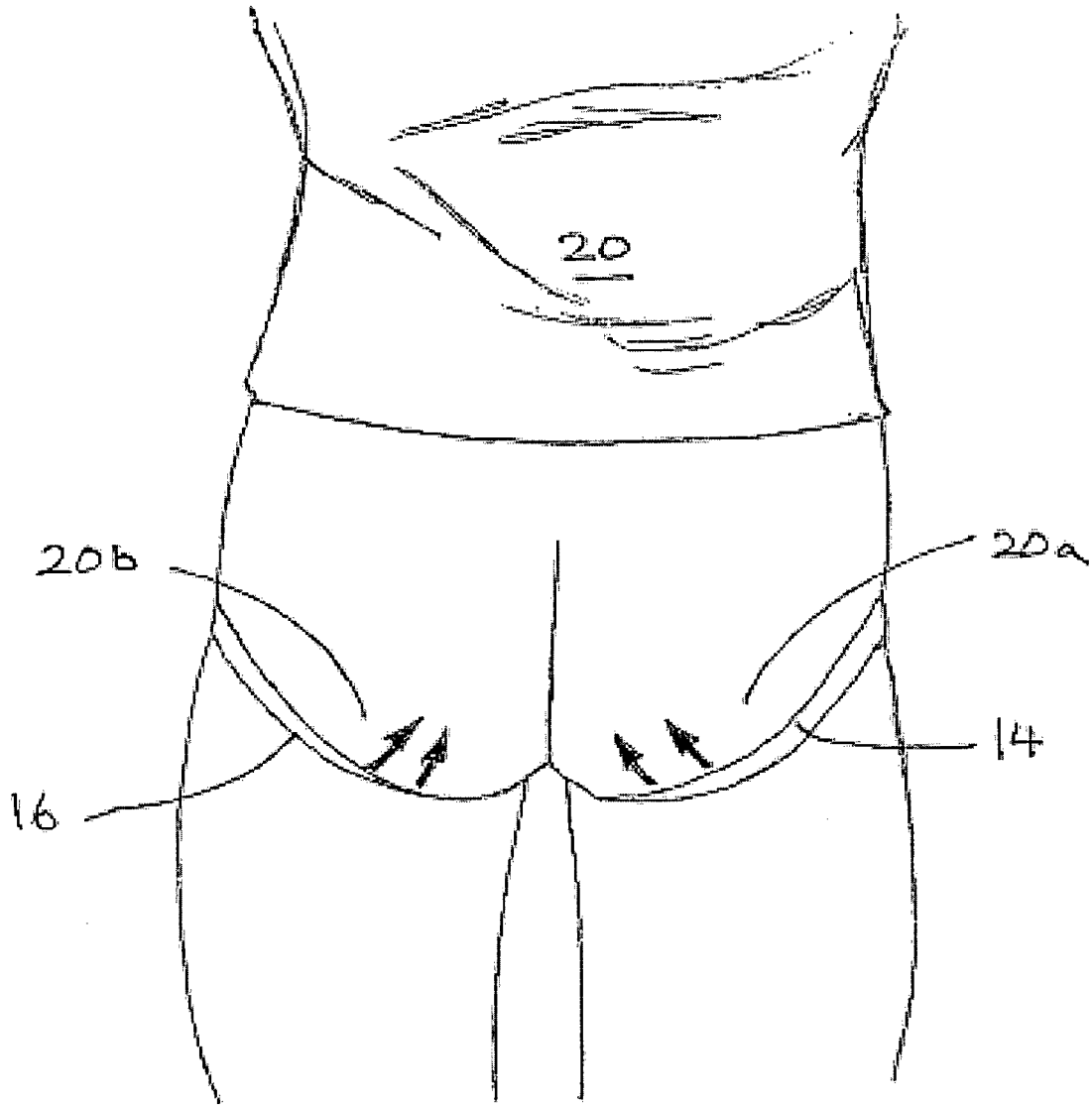

As shown in FIGS. 2 and 3, the undergarment 10 worn by the wearer 20 does not have a rear waistband and therefore this will not show through any clothes. As shown in the rear view in FIG. 3, the leg encircling members uplift the buttocks 20*a*, 20*b* to provide a better profile or contour beneath the clothes.

As shown in the side view in FIG. 2, the leg encircling straps 14 extend on either side of the wearer's legs 20*c* from the top of the crotch panel 12*a* to the bottom of the crotch panel 12*c* and is angled downwards from front to rear.

As shown in the rear view in FIG. 3, no strap members will be visible through clothing. Preferably the strap members 14, 16 are elasticized to provide a better fit or are typically a one size fits all fitting. In the alternative the strap members can have adjustment means such as VELCRO hook and loop fastener tabs or adjustable buckles 22 to adjust the length of the strap members and/or detatch the strap members from the crotch panel.

Figure 4:
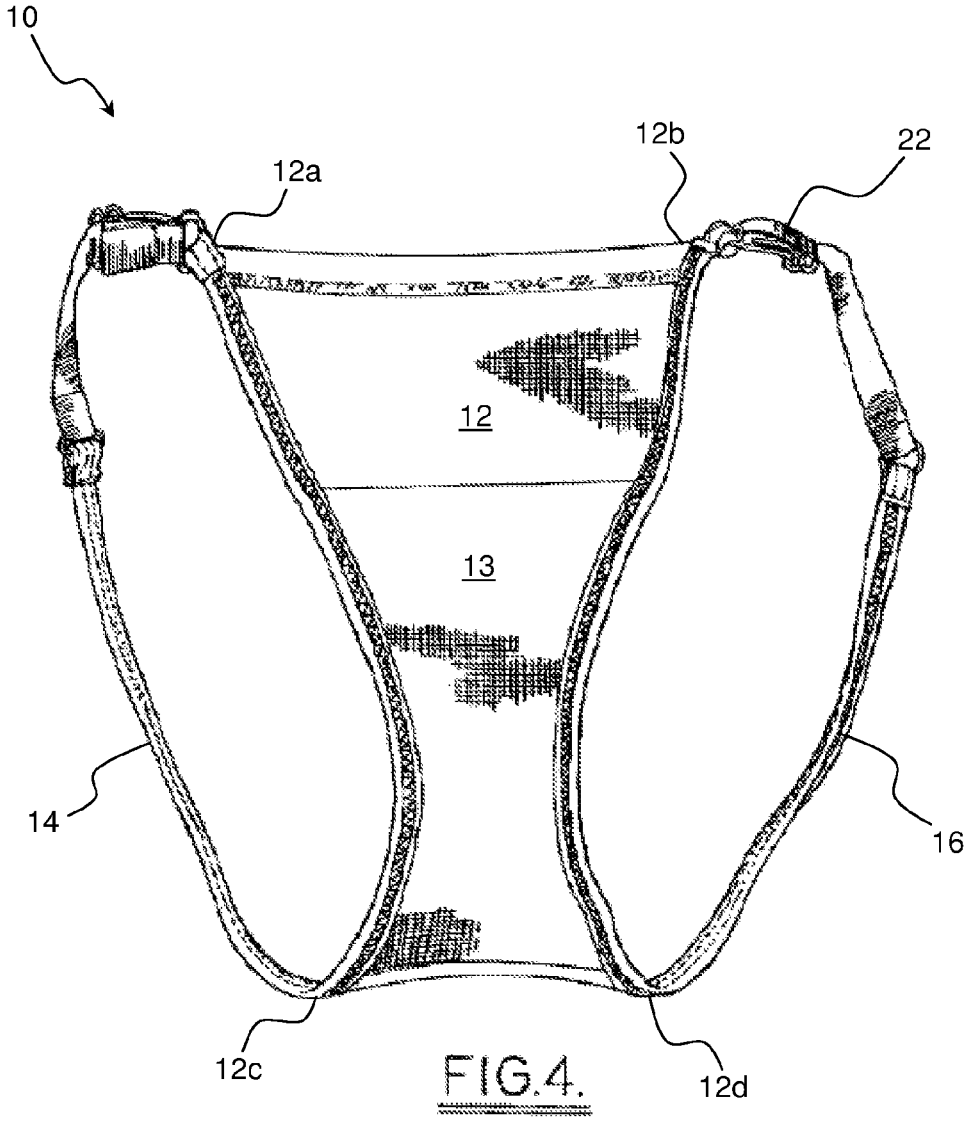
FIG. 4 shows a rear view of an embodiment of the invention.

FIG. 4 shows a rear view of an embodiment of the undergarment 10 having the same features illustrated in relation to FIG. 1.

Variations

It will of course be realized that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

The invention claimed is:

1. A female undergarment comprising:

a trapezoid shaped crotch panel defined by a wide top edge and a narrow bottom edge, the top and bottom edges joined by right and left side edges, the top and bottom edges and side edges defining top and bottom corners, on each side of the panel, said crotch panel being sized and configured to cover female genitalia of a wearer, and a pair of leg encircling straps, each strap joining the top and bottom corners on each side of the panel, wherein in use, each strap member encircles each leg of the wearer and extends under each buttock to locate and maintain position of the crotch panel without any portion of the garment covering the cheeks of the buttocks or extending across the back torso of the wearer.

2. A female undergarment comprising:

a crotch panel defined by a wide top edge and a narrow bottom edge, the top and bottom edges joined by right and left side edges, the top and bottom edges and side edges defining top and bottom corners, on each side of the panel, said crotch panel being sized and configured to cover female genitalia of a wearer, and a pair of leg encircling straps, each strap joining the top corner and the bottom corner on the same side of the panel, wherein in use, each strap member encircles each leg of the wearer and extends under each buttock whereby each leg encircling strap member joined to each top corner under tension between the corresponding bottom corner when worn applies an upward lifting force under each buttock to locate and maintain position of the crotch panel without any portion of the garment covering the cheeks of the buttocks or extending across the back torso of the wearer, the crotch panel and leg encircling straps being fabricated of sufficiently thin material to thereby present an uncovered contour of the buttocks and back when covered by an outer garment.

3. A female undergarment according to claim 1 wherein the crotch panel is made of a disposable material.

4. A female undergarment according to claim 1 wherein, the leg encircling straps are elasticized.

5. A female undergarment according to claim 1 wherein the leg encircling straps have an adjustable length.

6. A female undergarment according to claim 1 wherein, the straps are detachable from the crotch panel.

7. A female undergarment according to claim 1 wherein the crotch panel has an inner lining for preventing contact between an inner surface of the crotch panel and the wearer.

8. A female undergarment according to claim 2 wherein, the leg encircling straps are elasticized.

9. A female undergarment according to claim 2 wherein the leg encircling straps have an adjustable length.

10. A female undergarment according to claim 2 wherein, the straps are detachable from the crotch panel.

11. A female undergarment according to claim 2 wherein the crotch panel has an inner lining for preventing contact between an inner surface of the crotch panel and the wearer.

12. A female undergarment according to claim 11 wherein, the garment and/or the crotch panel is of a stretchable material and the inner lining is of an inert non-yeast propagating material.

13. A female undergarment according to claim 1 wherein the garment is fabricated of material to impart the impression no briefs are being worn underneath clothes.

14. A female undergarment according to claim 2 wherein the garment is fabricated of material to impart the impression no briefs are being worn underneath clothes.

15. A female undergarment according to claim 2 wherein the crotch panel has the shape of a trapezoid.

* * * * *